United States Patent [19]

Emanuel

[11] 4,155,200

[45] May 22, 1979

[54] PLASTIC STORM DOOR

[75] Inventor: Peter R. Emanuel, Marine City, Mich.

[73] Assignee: International Telephone and Telegraph Corporation, New York, N.Y.

[21] Appl. No.: 894,813

[22] Filed: Apr. 10, 1978

[51] Int. Cl.[2] ..... E06B 3/00

[52] U.S. Cl. ..... 49/501; 49/380; 52/630; 52/793; 52/807

[58] Field of Search ..... 49/501, DIG. 2, 380; 52/630, 793, 807

[56] References Cited

U.S. PATENT DOCUMENTS

| | | | |
|---|---|---|---|
| 2,927,354 | 3/1960 | Laner | 49/DIG. 2 |
| 2,948,366 | 8/1960 | Kelly et al. | 52/807 X |
| 3,250,041 | 5/1966 | Anger | 49/501 |
| 3,498,001 | 3/1970 | MacDonald | 49/501 |
| 3,599,703 | 8/1971 | Mennuto | 49/501 X |
| 4,012,549 | 3/1977 | Slysh | 52/630 X |

*Primary Examiner*—Kenneth Downey

*Attorney, Agent, or Firm*—James B. Raden; Harold J. Holt

[57] ABSTRACT

A plastic storm door comprising a unitary molded plastic panel having an integral solid skin. The panel has a channel along its peripheral edge having integrally molded load-transferring ribs diagonally traversing the width thereof. Hinges are secured along a vertical edge of the panel by attachment to tapping plates mounted within the channel between and bridging two of the load-transferring ribs. The ribs act to uniformly distribute the loading forces on the hinges throughout the panel. Elongated plastic strips enclose the channel to form an insulating airspace therein.

9 Claims, 8 Drawing Figures

PLASTIC STORM DOOR

This invention relates to a plastic storm door.

A number of attempts have been made to construct an all plastic or substantially all plastic storm door. Plastics have the potential ability to provide better insulation properties, greater resistance to rotting and cracking and greater design flexibility than the present materials of construction, most frequently aluminium or wood. However, plastic storm doors have heretofor lacked the necessary ridigity to prevent sagging or warpage. To compensate for this deficiency, it has been necessary to add reinforcement materials, such as steel strips, to strengthen the doors. This of course adds weight and cost and thus reduces the advantages of using plastic. Moreover, in order to provide such reinforcement it has been necessary to mold such doors from more than a single component rather than as a unitary molding and this too adds cost and in addition reduces the strength capability possible with a unitized construction.

It is a principal object of the present invention to provide an all plastic storm door having excellent strength characteristics, superior thermal insulation properties and great design flexibility.

It is a further object of this invention to produce a plastic storm door as an essentially unitary molded component.

It is still a further object of this invention to provide a plastic storm door having a construction such that the loading forces are uniformly distributed throughout the door.

It is a more specific object of this invention to provide a unique means for attachment to a storm door of door closing and door check devices.

The plastic storm door of the invention comprises an essentially one-piece unitary molded plastic panel of generally rectangular shape having a cellular core and an integral solid skin on both surfaces. The panel has a channel running along its peripheral edges. A series of integrally molded load-transferring ribs diagonally traverse the width of the panel. A plurality of metal tapping plates are mounted in spaced relationship within the channel along its vertical edge, each of the tapping plates being mounted between and bridging two of said load-transferring ribs. Hinges are fixedly secured to said tapping plates on the exterior surface of the vertical edge. By virtue of this structural relationship, the ribs act to uniformly distribute the loading forces on the hinges throughout the panel. The storm door has elongated plastic strips adhesively or otherwise secured to the panel to enclose the peripheral channel and form an insulating airspace therein.

The invention will be better understood by reference to the accompanying drawing in which FIG. 1 is an elevational view of the inner surface of a door in accordance with the invention;

Figure 1:
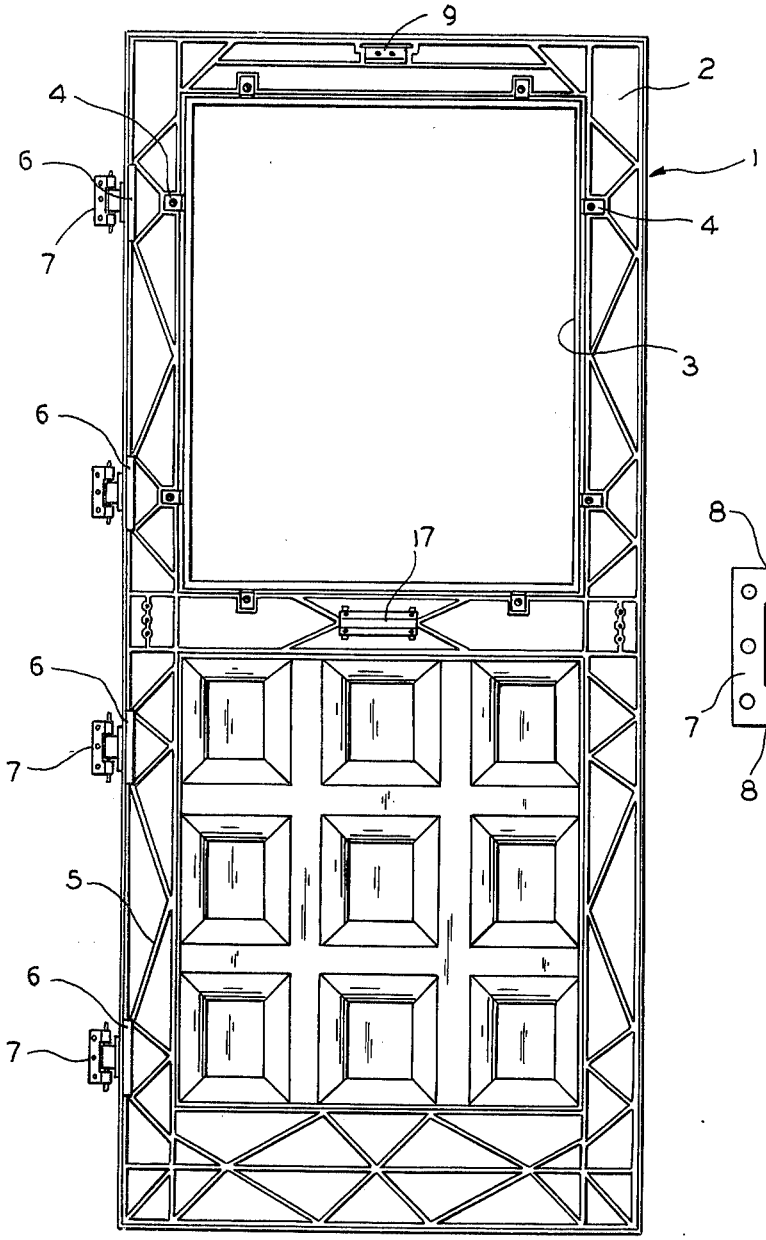
Figure 2:
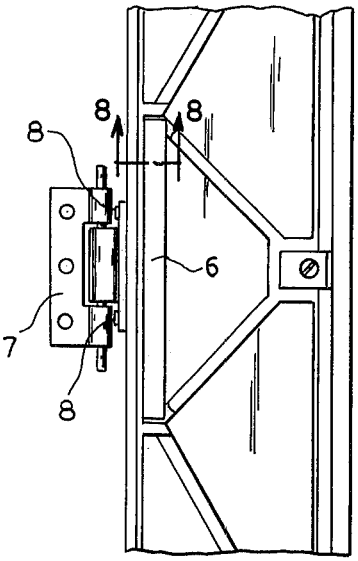
FIG. 2 is an enlarged fragmentary view of a portion of the door shown in FIG. 1 to show the manner of attachment of a hinge.
Figure 8:
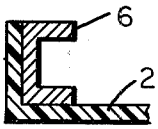
FIG. 7 is an elevational view of the completed door of FIG. 1 with the peripheral channel of the door covered with plastic strips and FIG. 8 is a crossectional view of the tapping plate and adjoining panel surface taken along the lines 8—8 of FIG. 2.
Figure 3:
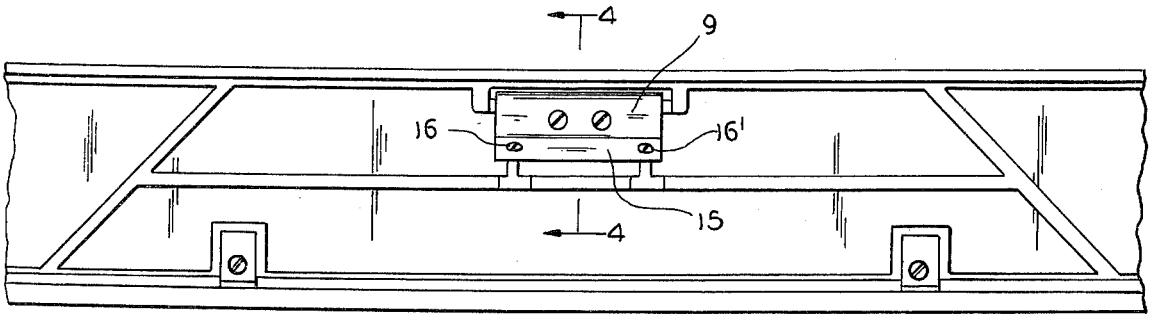
FIG. 3 is an enlarged fragmentary view of another portion of the door of FIG. 1 to show the manner of attachment of a door closer.
Figure 5:
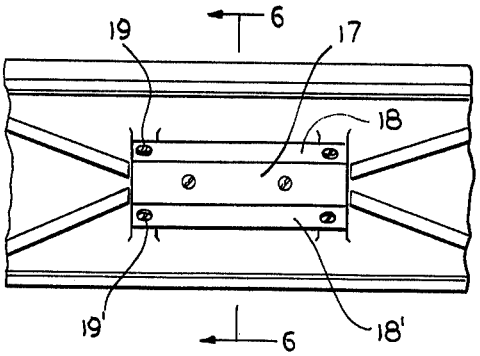
FIG. 5 is an enlarged fragmentary view of still another portion of the door of FIG. 1 to show the manner of attachment of a door check.
Figure 4:
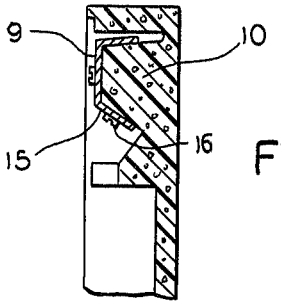
FIG. 4 is a crossectional view taken along the lines 4—4 of FIG. 3.
Figure 6:
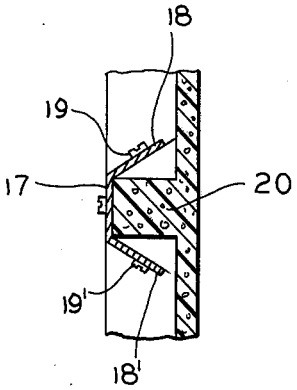
FIG. 6 is a crossectional view taken along the lines 6—6 of FIG. 5.
Figure 7:
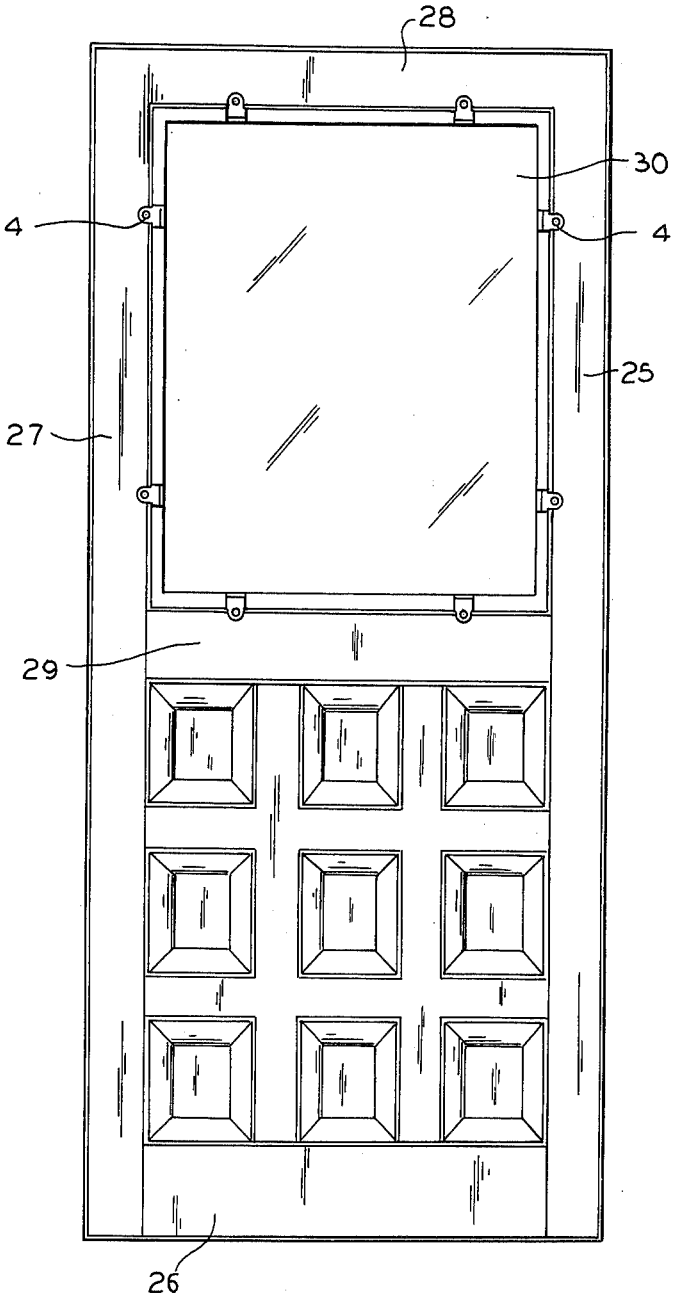

As shown in the drawing, the door comprises a plastic panel generally indicated at 1. The panel is a unitary molded rectangular piece made of a foamed plastic having an integral solid skin on both its inner and outer surface. The panel has a continuous channel 2 around its peripheral edge and a large opening 3 adapted to retain a screen or window by clips 4. Channel 2 also extends around the bottom portion of the opening 3 so that the channel completely surrounds the opening. A series of integrally molded ribs 5 traverse the width of the channel to form a generally triangular truss configuration. To provide additional support along the bottom of the door, additional ribs are located in an additional channel just above the bottom channel on the door. In spaced relationship along a vertical edge of the panel are four metal tapping plates 6 mounted between and bridging two of said load-transferring ribs 5. As most clearly seen in FIG. 8, each tapping plate is of U-shaped or channel configuration which allows load distribution to the stress points. Hinges 7, preferably of metal, are secured to the tapping plates as by metal screws 8.

The four hinges are thus mounted in a fashion which distributes the load through the tapping plates to eight stress points. The rib design uniformly distributes the hinge loading forces across the door structure. The triangular truss configuration within channel 2 is most efficient in load distribution and also in preventing sagging and warpage, a well known weakness of plastic structural foam. This door configuration provides superior hinge and physical load bearing characteristics without the necessity for reinforcement with steel strips or other structural reinforcement materials.

The means of attachment for a door closer or door check device in accordance with the invention is shown in FIGS. 3-6. A metal tapping plate 9 is mounted on plastic protrusions 10 formed integrally with the plastic panel 1 at an intermediate position laterally within the top peripheral channel. Tapping plate 9 is canted at a 45° angle to form a surface 15 containing screw holes for securing the plate to the protrusions through screws 16 and 16'. It will be seen that the screws 16 and 16' are at a 45° angle to the force vector of a door check device (not shown) attached to plate 9. Similarly, metal tapping plate 17 has 45° canted surfaces 18 and 18' through which attachment screws 19 and 19' secure the plate 17 to plastic protrusions 20. Thus, the affixing screws 19 and 19' are at a 45° angle to the pull-out forces of a door closing device (not shown).

The typical method of attachment of door closers or door checks in conventional storm doors utilizes only the thread holding power of screws in the plane of pull victors. In the present design, the plastic itself must fail by shear. The area of shear is much greater than the area of screw thread. Hence the holding strength is developed not only through screw thread areas but also via the canted attachment design. Moreover, all externally mounted metal components including hinges, door checks and door closing devices are mounted through metal-to-metal tapping plates thus insuring the strength and integrity of the mounting.

The door is completed by attaching, as for example adhesively, five elongated plastic strips 25, 26, 27, 28 and 29 to enclose the channel 2 to form an insulating airspace. Window 29 may then be inserted and held in place by clips 4. Particular suitable clips are disclosed in copending application Ser. No. 894,814 filed of even date herewith.

As compared to an aluminum structural storm door, the door of the invention has much greater diagonal and lateral door loading properties as the door and ribbing are of unitized construction. Aluminum doors rely for strength on friction between skin and sub-structure and screw holding power, i.e., a "welded" door is stronger than a screwed door. As compared with other plastic doors assembled in two halves, the present door is also stronger because it is a unitized structure.

An important feature of the invention is its considerably improved thermal insulation characteristics. As most clearly seen in the crossectional views of FIGS. 4 and 6, the door has a foamed plastic interior with an essentially solid skin on both exterior surfaces. Thermal performance tests have indicated that thermal losses from the plastic doors of the invention are from 26 to 42% less than comparable aluminum doors, depending on whether the present doors are single or double glazed. The corresponding results for heat retained by the present doors ranged from 36 to 74% more than a comparable aluminum door.

Both the panels and the elongated strips of the present invention are preferably molded from a thermoplastic resin such as polystyrene. However, other plastic materials such as polymers and copolymers of olefinically unsaturated compounds and their derivatives including polyethylene and polypropylene may be used as well as nylons, polycarbonates, phenolics and polyurethanes. The panels may be injection molded as, for example, by the processes disclosed in U.S. Pat. Nos. 3,268,636 and 3,436,446.

I claim:

1. A plastic storm door comprising a unitary molded plastic panel having a cellular core and an integral solid skin on both surfaces thereof, said panel being of generally rectangular shape, said panel having a channel along the peripheral edges thereof, said channel having a series of integrally molded load-transferring ribs diagonally traversing the width thereof, a plurality of tapping plates mounted in spaced relationship within said channel along a vertical edge of the panel, each of said tapping plates being mounted between and bridging two of said load-transferring ribs, hinges fixedly secured to said tapping plates on the exterior surface of said vertical edge, said ribs acting to uniformly distribute the loading forces on said hinges throughout said panel.

2. The storm door of claim 1 in which elongated plastic strips enclose said peripheral channel to form an insulating airspace therein.

3. The storm door of claim 1 in which said channel is U-shaped.

4. The storm door of claim 1 in which the channel is continuous around the entire periphery of the panel.

5. The storm door of claim 1 in which said panel has a large opening therein adapted to retain a screen or window therein and said channel completely surrounds said opening.

6. The storm door of claim 1 in which said ribs form a series of triangular truss configurations in said channel.

7. The storm door of claim 1 in which said tapping plates are of metal and are U-shaped to enhance load distribution to the panel.

8. The storm door of claim 1 in which one or more metal tapping plates are mounted at an intermediate position laterally within the channel to provide for attachment of door closing and door check means.

9. The storm door of claim 8 in which said door closing and door check tapping plate is U-shaped, one leg of said tapping plate being utilized for attachment to said panel so that attachment of said tapping plate to said panel is at an angle to the door closing or door check force vector.

* * * * *